US006161238A

United States Patent [19]

Graebe

[11] Patent Number: 6,161,238

[45] Date of Patent: Dec. 19, 2000

[54] WRAPAROUND ORTHOTIC BASE, COMPOSITE ADJUSTABLE CUSHION USING SAME AND METHOD OF MEASURING FIT OF THE ADJUSTED CUSHION TO THE USER'S SHAPE

[76] Inventor: Robert H. Graebe, 7 Pesimmon Ridge Dr., Belleville, Ill. 62223

[21] Appl. No.: 09/137,980

[22] Filed: Aug. 21, 1998

Related U.S. Application Data

[62] Division of application No. 08/688,985, Jul. 31, 1996.

[51] Int. Cl.[7] ..... A47C 20/02

[52] U.S. Cl. ..... 5/648; 5/640; 5/652; 297/DIG. 4; 297/452.28

[58] Field of Search ..... 5/630, 640, 648, 5/652, 652.1, 655.9, 657, 725; 297/219.11, DIG. 4, 452.28

[56] References Cited

U.S. PATENT DOCUMENTS

| | | | |
|---|---|---|---|
| D. 294,212 | 2/1988 | Sias et al. . | |
| 1,742,186 | 1/1930 | Claus . | |
| 3,308,491 | 3/1967 | Spence . | |
| 3,382,511 | 5/1968 | Brooks | 5/652 |
| 3,679,263 | 7/1972 | Cadiou . | |
| 3,987,507 | 10/1976 | Hall . | |
| 4,525,886 | 7/1985 | Savenije . | |
| 4,541,136 | 9/1985 | Graebe . | |
| 4,605,582 | 8/1986 | Sias et al. . | |
| 4,628,557 | 12/1986 | Murphy . | |
| 4,643,481 | 2/1987 | Saloff et al. . | |
| 4,660,238 | 4/1987 | Jay . | |
| 4,673,605 | 6/1987 | Sias et al. . | |
| 4,698,864 | 10/1987 | Graebe . | |
| 4,726,624 | 2/1988 | Jay . | |
| 4,744,351 | 5/1988 | Grundei et al. | 5/630 |
| 4,753,480 | 6/1988 | Morell . | |
| 4,761,843 | 8/1988 | Jay . | |
| 4,796,948 | 1/1989 | Paul et al. . | |
| 4,856,844 | 8/1989 | Isono . | |
| 4,947,500 | 8/1990 | Sieler . | |
| 4,953,913 | 9/1990 | Graebe . | |
| 5,052,068 | 10/1991 | Graebe . | |
| 5,163,196 | 11/1992 | Graebe et al. . | |
| 5,163,737 | 11/1992 | Navach et al. . | |
| 5,189,747 | 3/1993 | Mundy et al. . | |
| 5,203,607 | 4/1993 | Landi . | |
| 5,226,188 | 7/1993 | Liou . | |
| 5,277,473 | 1/1994 | Kelly et al. . | |
| 5,369,828 | 12/1994 | Graebe . | |
| 5,378,045 | 1/1995 | Siekman et al. . | |
| 5,395,162 | 3/1995 | Jay et al. . | |
| 5,502,855 | 4/1996 | Graebe . | |
| 5,524,640 | 6/1996 | Lisak et al. . | |

OTHER PUBLICATIONS

TRI–MAX Information Sheet D–8083 dated Jan. 1, 1989.

*Primary Examiner*—Terry Lee Melius
*Assistant Examiner*—Fredrick Conley
*Attorney, Agent, or Firm*—Polster, Lieder, Woodruff & Lucchesi, L.C.

[57] ABSTRACT

A cushion comprising an orthotic base which has a flexible body of sufficient strength to support a user while conforming to the buttocks and legs of the user and pillars on the bottom of the base to support the same and being of desired height and positioning to position the user in a desired position. The disclosure shows a preferred composite cushion comprising the orthotic base; a foam top on the base with a T-shaped cutout at the rear to accommodate an air cell pad; a balance foam underpad of smaller front to rear measurement than the base and movable from the front to the rear of the base to incline the user in a desired front to rear positioning and from left to right to position the user in a left to right direction; and a cover enclosing the base, the foam top, the air cell pad and the underpad. Removable support members are attached to the pillars beneath the orthotic base at predetermined locations to shape the top surface when a load is applied. Removable shapes also can be located on the top surface of the base to position the user in desired positions. Openings are provided through the base to facilitate moisture removal from and air circulation to the user. A method of measuring the conformity of the cushion to the shape of the user using a memory foam pad is shown.

3 Claims, 8 Drawing Sheets

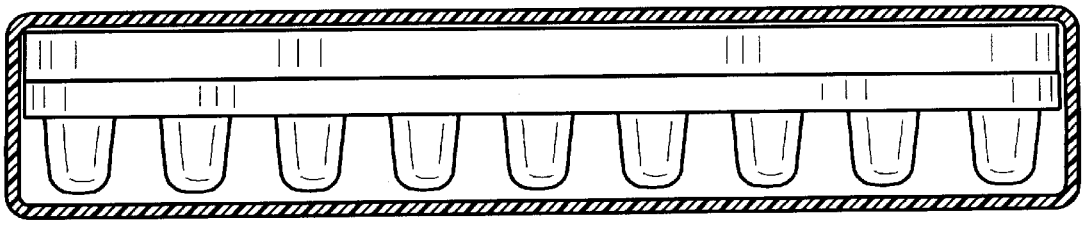
FIG. 19
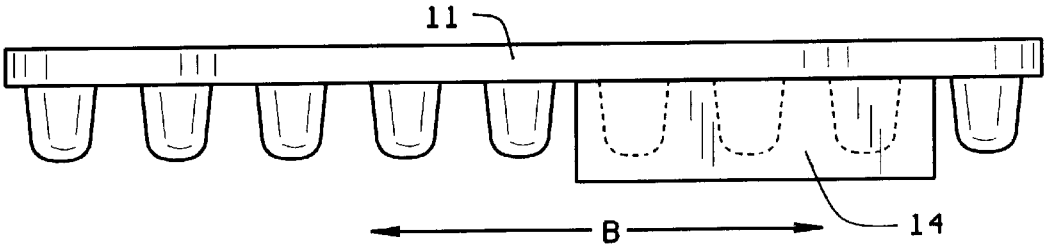
FIG. 17
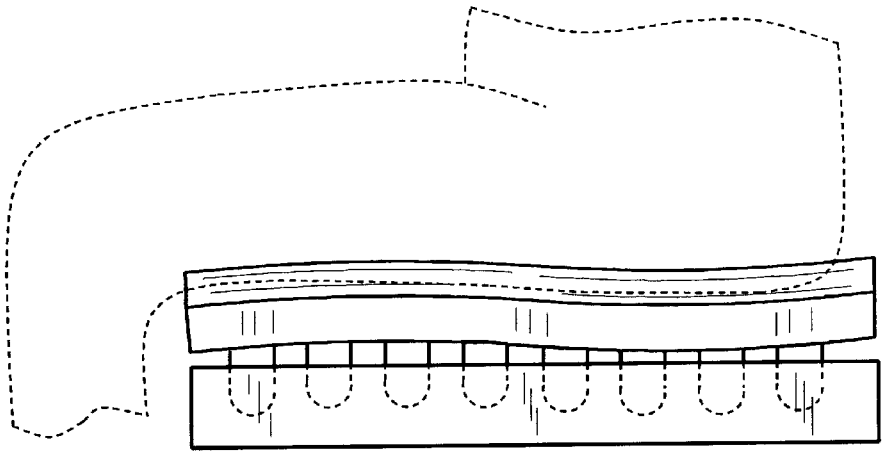
FIG. 20
FIG. 21
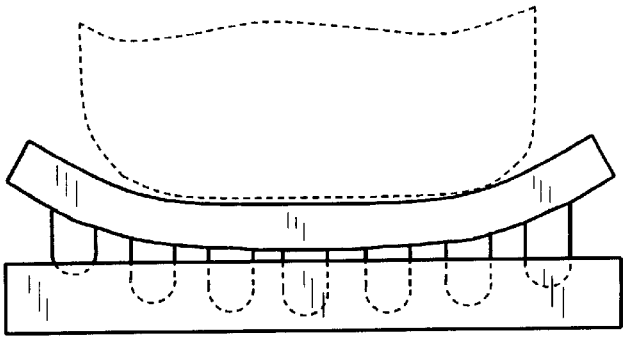

WRAPAROUND ORTHOTIC BASE, COMPOSITE ADJUSTABLE CUSHION USING SAME AND METHOD OF MEASURING FIT OF THE ADJUSTED CUSHION TO THE USER'S SHAPE

This is a divisional of copending application Ser. No. 08/688,985 filed on Jul. 31, 1996.

BACKGROUND OF THE INVENTION

This invention relates in general to cushioning devices and, more particularly, to a wheelchair cushion which features an orthotic base which shapes on contact to wraparound the buttocks of the user, i.e., the person seated on the base, to immerse the user in the base and increase surface area contact between the user and the base, thereby reducing the peak pressures on the skin surface of the user. The invention also accommodates air cell and/or soft foam additions to the surface of the orthotic base which will further enhance fitting the shape of the person on contact so as to enhance wraparound of the buttocks of the user to, in effect, immerse the person and increase surface area contact between the user and the cushion. The orthotic wraparound base is designed to have a combination of support pillars of various lengths and an interconnecting top layer, both of which can be molded of one material in a flat mold, or alternatively assembled from individual parts. In this alternative assembly, cut pieces of foam or plastic equivalent to the pillars are attached with glue or mechanical fasteners to the under side of a flexible sheet of plastic or a sheet of foam.

Those who must spend extended time in wheelchairs run the risk of tissue breakdown and the development of ischemic sores, which are extremely dangerous and difficult to cure. These ischemic ulcers (pressure sores or decubitus ulcers), typically form in areas where bony prominences exist, such as the ischia, heels, elbows, ears and shoulders. Typically, when sitting, much of the individual's weight concentrates in the regions of the ischia, that is at the bony prominences of the buttocks, and unless frequent movement occurs, or there is a reduction in the deformation of these soft tissues, the flow of blood to the soft tissue in these regions decreases to the point that in time the tissue breaks down (this is known as necrosis). This problem is well known and many forms of cushions are especially designed for wheelchairs for reducing the concentration of weight in the region of the ischia, and these cushions generally seek to distribute the user's weight more uniformly over a larger area of the buttocks to reduce the amount of deformation to the soft tissues which include the vascular bed.

The trochanter area is another area where problems occur in wheelchair patients. To address this problem the bases for wheelchair cushions are shaped to try to load the thighs and reduce the suspension forces on the ischia and the trochanters. This distribution of suspension forces to the thighs serves as a fulcrum so the weight of the legs lifts the buttocks. Still another problem with wheelchair type cushions is stabilization and positioning of the user, so that he has a feeling of security and improved functionability when sitting in the wheelchair. To address this, the fulcrum point needs to be movable and the fit of the cushion to be adjustable to suit the individual, thereby attaining the optimum balance of suspension forces in each individual user.

A number of patents issued to Robert H. Graebe show cellular cushions which comprise an array of closely spaced cells which project upwardly from a common base and are interconnected to permit an enclosed fluid, such as air, to transfer throughout the cushion. These cushions combine the most uniform distribution of weight available in wheelchair cushions, and thus provide the greatest protection from the occurrence of ischemic ulcers/pressure sores. Since the cells communicate with each other in the Graebe cushions, all exist at the same internal pressure and each cell exerts essentially the same restoring force against the buttocks, irrespective of the extent to which it is deflected. Graebe U.S. Pat. No. 4,541,136 is typical of these patents and shows a cellular cushion currently manufactured and sold by Roho, Inc. of Belleville, Ill. under license from Graebe for use on wheelchairs.

The stability problem has been attacked by the use of preshaped bases such as shown in Graebe U.S. Pat. No. 4,953,913 and Jay et al. U.S. Pat. No. 4,726,624. These bases are generally used in conjunction with cushions and Graebe U.S. Pat. No. 4,953,913 has been used in conjunction with a cellular cushion and a fabric cover. The stability problem also has been addressed in the cellular cushion field by the use of zoned areas of inflation as shown in Graebe U.S. Pat. Nos. 4,698,864 and 5,052,068 which show zoned cellular cushions with cells of varying height and Graebe U.S. Pat. Nos. 5,163,196 and 5,502,855 which show other forms of zoned cushions with cells of uniform heights.

As noted, it is known to use rigid shaped bases in combination with a wheelchair user engaging cushion as shown in Jay et al. U.S. Pat. No. 4,726,624. It also is known to use an air cell cushion with a rigid shaped base as exemplified in the Roho TRI-MAX cushion. Graebe U.S. Pat. No. 5,369,828 shows another form of composite cushion which utilizes a rigid shaped foam base with a cellular pad on a flat rear surface with a fabric cover over the entire cushion.

Finally, Sias et al U.S. Pat. Nos. 4,605,582, 4,673,605 and D294,212 (now owned by Robert H. Graebe), also show a form of base with pillars and bubbles extending from both sides of a center member to support a user above a fixed surface.

The present invention comprises in its broadest sense a semi-rigid orthotic base having an adjustable support profile (attained by trimming individual support pillars) which is designed to conform to the general shape of a typical user's buttocks, and which can be reshaped to provide the desired positioning of the buttocks of the user. In addition to conforming to the user's buttocks, the base of this invention also has sufficient strength to support the weight of the user. The base has a series of spaced support pillars and a flexible interconnecting top layer. Using this invention, the support members on the underside of the base can be trimmed to provide, under load, a desired upper surface profile designed for and specifically adapted to the shape of the user. The elasticity and resilience of the base is such that when the load on the top is educed or removed, the top surface of the base will recover to its original flat shape. This inherent characteristic helps the user to transfer on and off the cushion.

In another form of the invention, an optional air cell pad is positioned on the top layer of the base beneath the ischia of the user to equalize the suspension forces and to better assume the shape of the hips and its ischia, thereby reducing deformation of the vascular system and thus facilitating blood flow to the skin at these critical areas. A soft foam pad covers the remainder of the base, but has a cutout area to expose the air cells when they are used. This arrangement provides a continuous comfortable smooth feel for the user of the cushion over its entire surface area, while maintaining the therapeutic value of the air cells over the critical ischia area.

A foam balance pad with holes to match the base pillars can be positioned beneath the orthotic base to act as a fulcrum to tilt the base forward or backward or from one side to the other, depending on the balancing and positioning needs of the user. The foam pad is of lesser front to back size than the orthotic base. The balance pad can be inserted beneath and fitted into the pillars of the orthotic base and moved toward the front or rear of the base to correspondingly adjust the tilt of the base and the tilt of the user of the cushion. It can also be rotated beneath the base and moved from side to side to accommodate the postural needs of the user toward one side of the base or the other.

The present invention also provides for the use of a removable or fixed pommel at the center of the front of the base to divide the legs of the user. Removable side adjustment members also are positionable at the front and rear side edges of the base to further direct and locate the legs and buttocks of the user.

Removable shaped blocks can be positioned beneath the base and engaged with the pillars to similarly shape the base. The blocks can be of dense foam or wood and can be positioned at the center of the front of the base to form a pommel or beneath the side edges to bend the edges upwardly to induce positional and additional shape functions.

SUMMARY OF THE INVENTION

In its broadest aspects, it is a principal object of this invention to provide an orthotic base which has a body portion of sufficient flexibility to conform to the shape of the user and spaced pillars molded with and positioned beneath the body and possessing sufficient strength and length to support the buttocks and body weight of the user. In a preferred form, the invention comprises a composite cushion which includes the foregoing orthotic base, an air cell pad attachable to the orthotic base beneath the ischia of the user, and a cover which encloses the cushion components. Another object is to provide a balance pad for the cushion which is positioned beneath the base, and being of lesser width than the base, can be moved forward or rearward with respect to the base to adjust the forward or rearward tile of the user of the base. The balance pad also can be rotated beneath the base and moved from side to side to tilt the base to the left or right, depending on need. These and other objects and advantages will become apparent hereinafter.

This invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 17 is a front elevational view showing the stabilizer member rotated 90°;

FIG. 19 is a side view of a modification of the invention showing a base and pad surrounded by a cover shown in section;

FIGS. 20, 21 and 22 are similar to FIGS. 9–11, but show the base on a memory impression pad to check the pressure distribution of the user prior to trimming the pillars;

DETAILED DESCRIPTION

Figure 1:
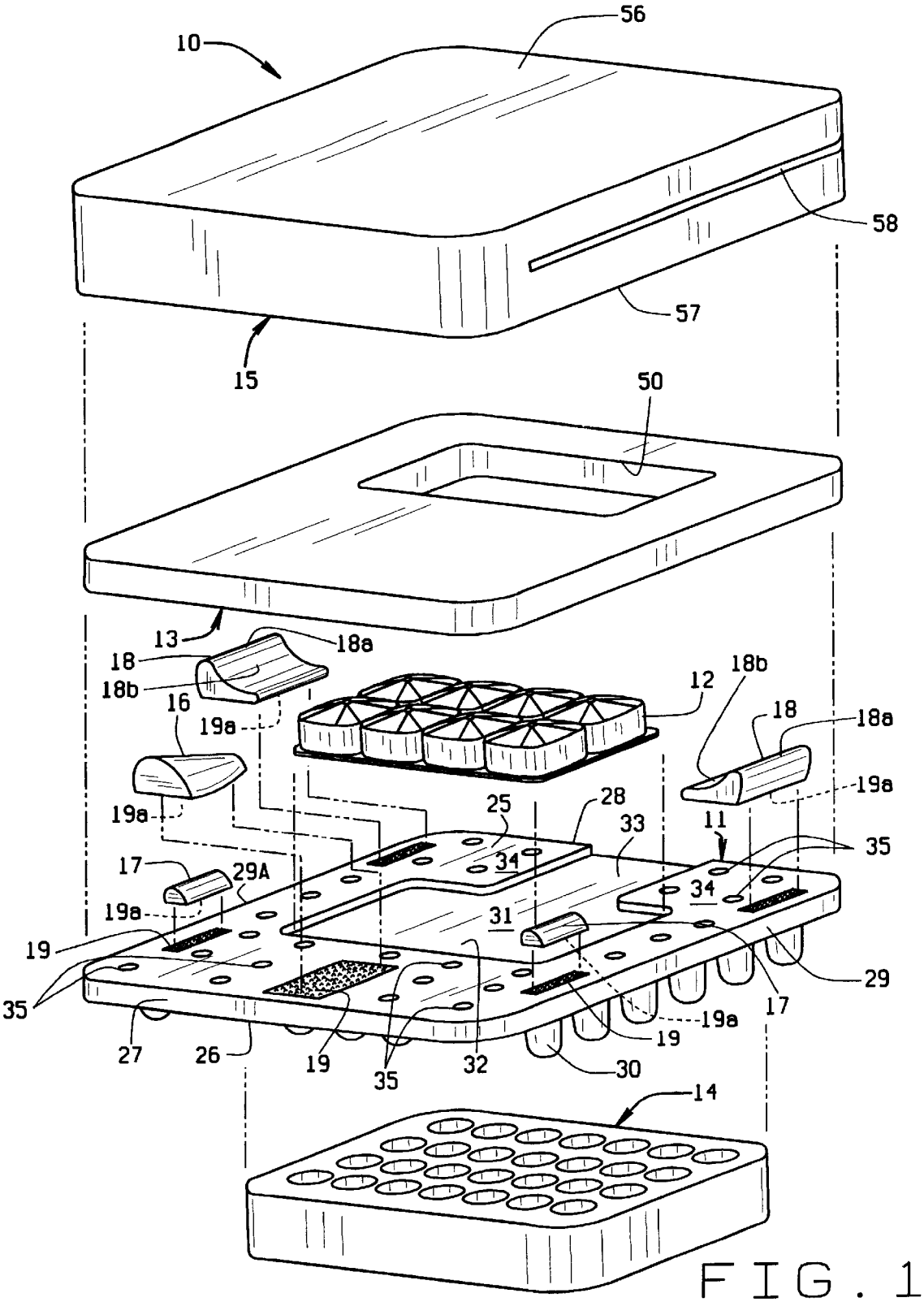
FIG. 1 is an exploded perspective view of one form of the cushion of this invention.
Figure 2:
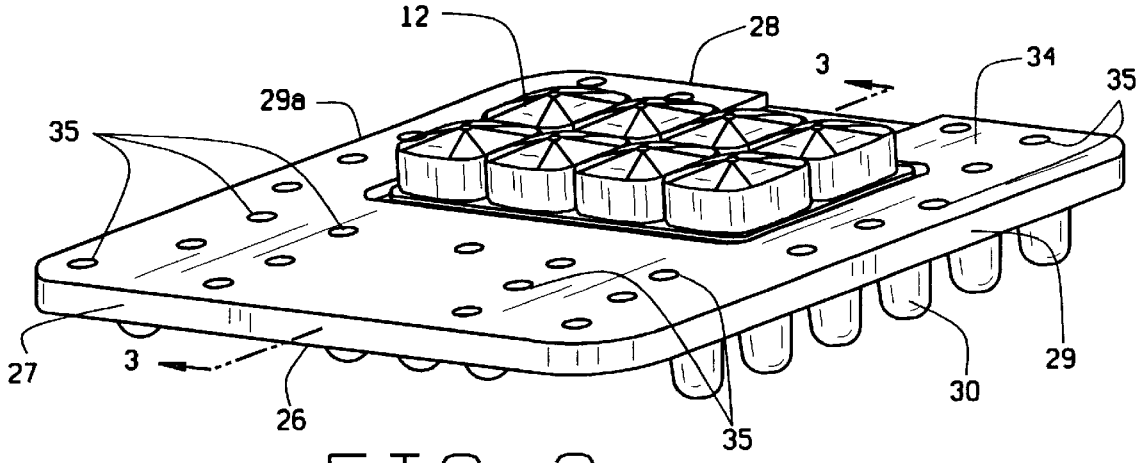
FIG. 2 is a perspective view of the orthotic base and air cell pad insert.
Figure 3:
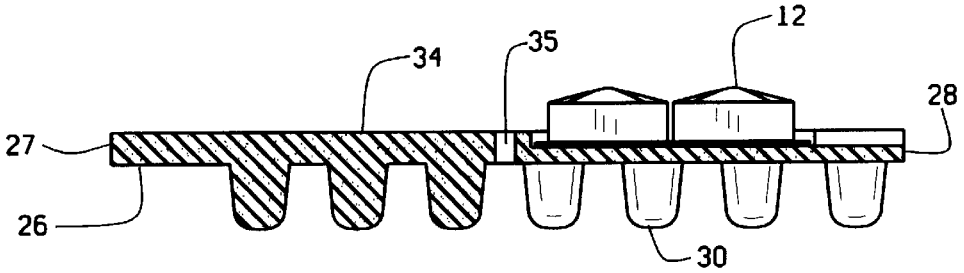
FIG. 3 is a sectional view taken along line 3—3 of FIG. 2.
Figure 4:
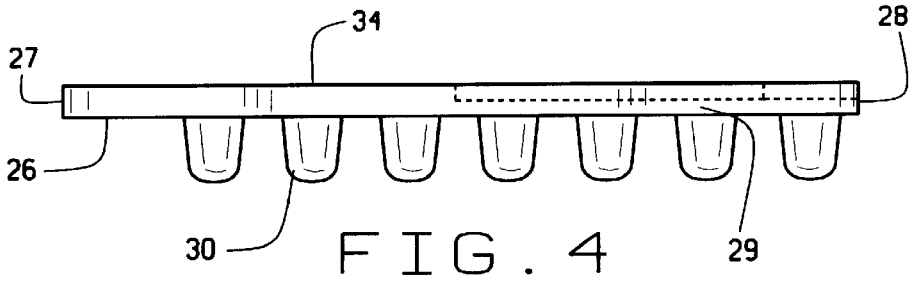
FIG. 4 is a side elevational view of the orthotic base shown in FIG. 2.
Figure 5:
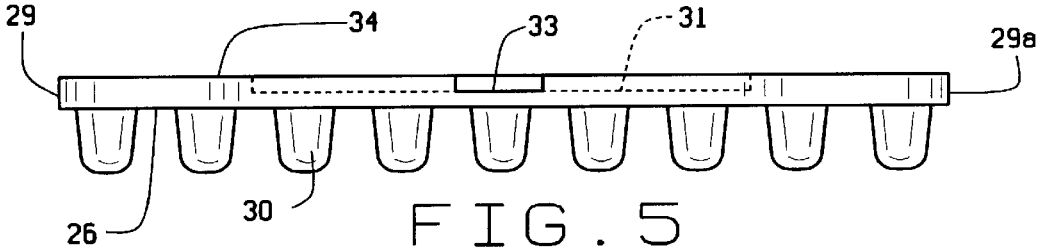
FIG. 5 is a rear elevational view of the base shown in FIG. 4.
Figure 6:
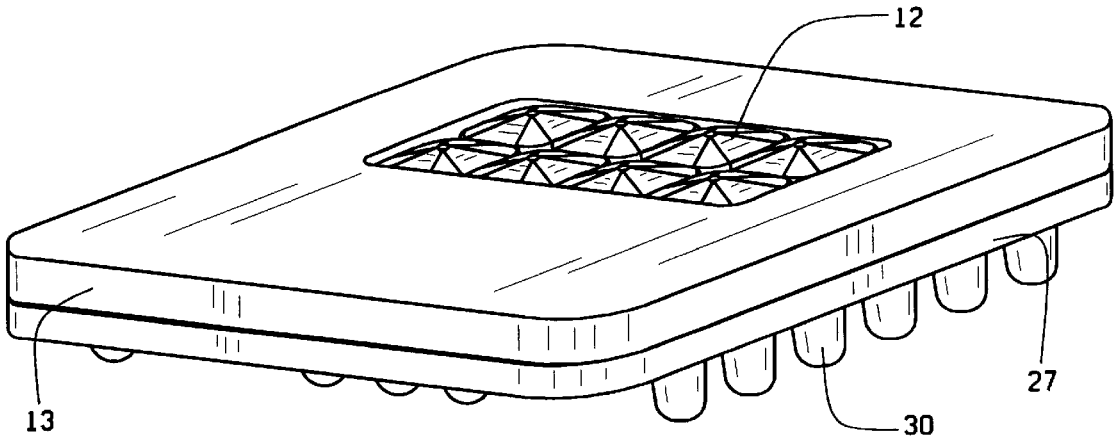
FIG. 6 is a perspective view of a cushion without the cover.

FIG. 1 shows the preferred form of the composite cushion 10 of this invention in exploded form. In its preferred embodiment, the cushion 10 comprises an orthotic base 11, an inflatable air cell pad 12, a top foam pad 13 positionable on the base 11, a bottom stabilizer and balance member 14 positionable beneath the base 11, and a cover member 15. In addition, there are optional components usable with the preferred form of the invention and which can be positioned on the base 11 and enclosed within the cover 15. These include a removable pommel 16, leg positioning members 17, and buttocks positioning members 18. The parts 16, 17 and 18 are removably attached to the base 11 by suitable fastening means, such as snaps, or the shown VELCRO strips 19. When the VELCRO strips 19 are attached to the orthotic base 11, similar strips 19*a* are positioned on the components 16, 17 and 18.

The positioning members 18 are shaped to fit the buttocks and have an outer rim 18*a* and a sloped or inclined top surface 18*b* which tapers from the rim 18*a* toward the user.

Figure 25:
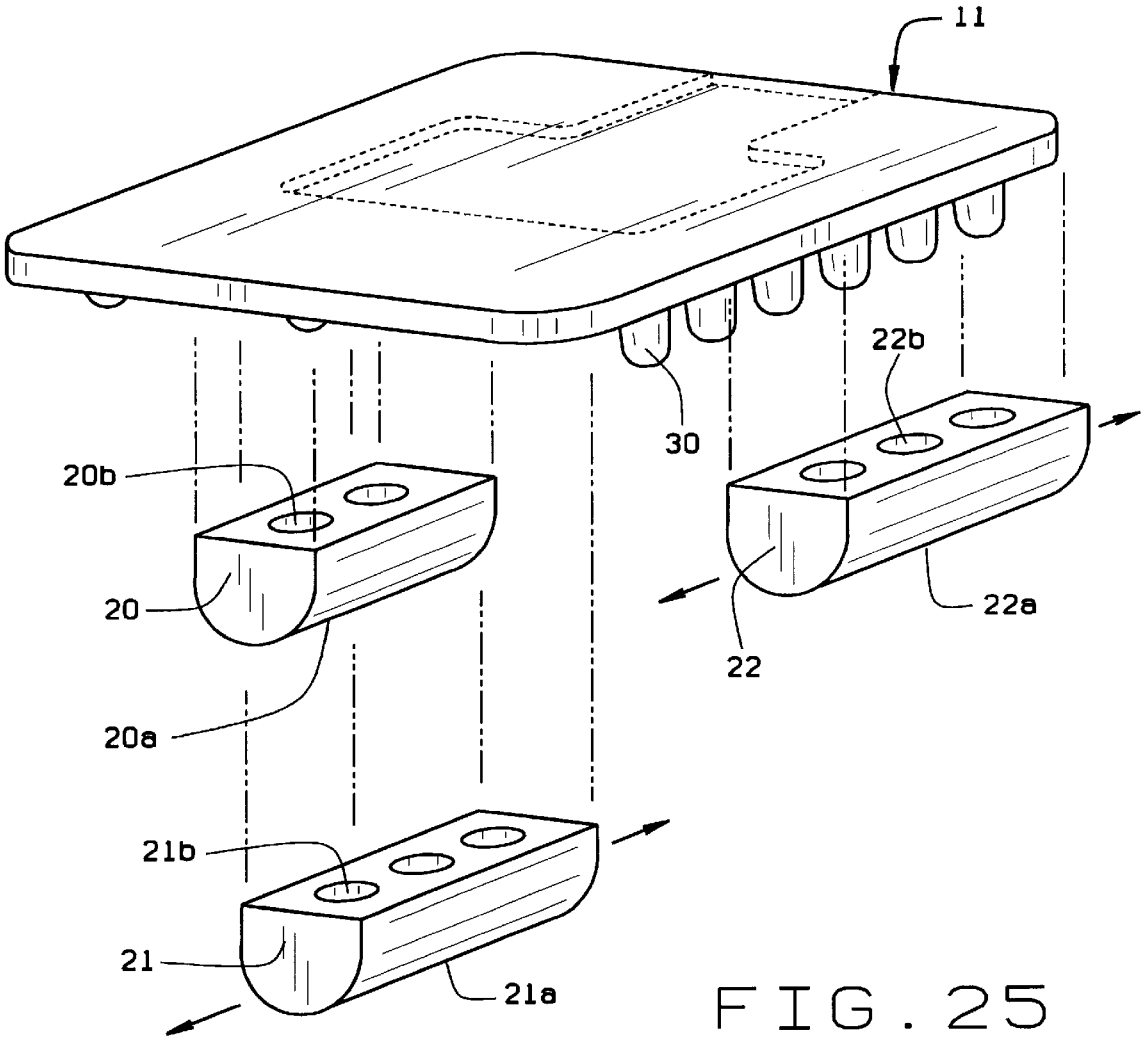
FIG. 25 is an exploded perspective view similar to FIG. 1 but of a modification of the invention.
Figure 26:
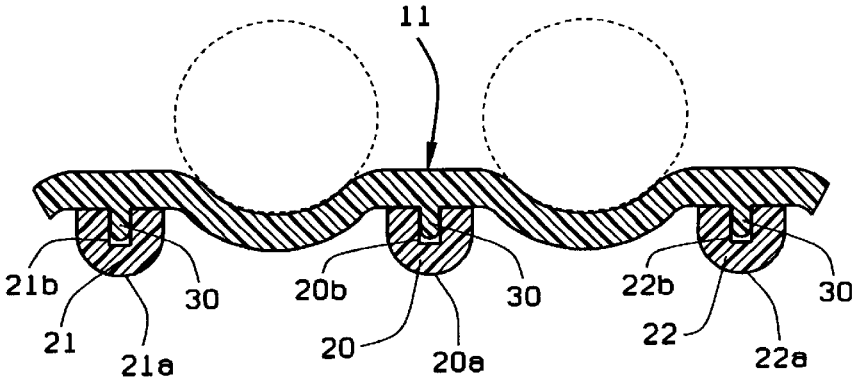
FIG. 26 is a vertical sectional view taken through the structure of FIG. 25 in assembled form showing the legs of a user in broken lines.

An alternative form of positioning is shown in FIGS. 25 and 26. In this form of the invention the positioning members are shaped blocks 20,21,22 which are positionable beneath the base 11 and have curved outer surfaces 20*a*, 21*a*,22*a*, respectively which engage the surface the base 11 is placed on. The blocks 20,21,22 have openings 20*b*,21*b*, 22*b* which are shaped and aligned to accept the base pillars 30. The operation of the blocks 20,21,22 is to cause the base top 25 to bend upwardly when load is applied to the base 11. Thus, the final result is that the base top 25 is reshaped to the requirements of the user. The blocks 20,21,22 can be a dense foam plastic or wood. The center block 20 acts to form a pommel in the base 11 while the side edge blocks 21,22 define leg troughs and raised trochanter positioning areas in the base 11. The blocks 21,22 can be moved forwardly or rearwardly as noted by the arrows in FIG. 25. They also can extend the entire length of the side edges of the base 11. The blocks 21, 11 also can be formed in two or more sections and can be of different heights, depending on the positioning needs of the user.

The key element in the composite cushion 10 is the wraparound orthotic base 11 which can be used without the air cell pad 12 and the balance member 14. The foam pad 13 and the cover 15 preferably are used with the base 11 ever when it is utilized without the other elements. This is shown in FIG. 19.

The base 11 preferably is molded or cast from a thermoplastic polymeric material such that the finished product is moisture resistant and has sufficient rigidity and strength to support the weight of the user, but still has sufficient flexibility to conform to the shape of the hips and buttocks of the user to provide a wraparound effect which gives greater contact area and consequently lower pressures and lower suspension forces on the skin of the user. The base 11 can be made moisture impervious by molding a plastic water impervious sheet onto the top surface.

The orthotic base 11 has a top surface 25, a bottom surface 26, a front edge 27, a back edge 28 and opposed side edges 29,29*a*. Depending from the bottom surface 26 of the orthotic base 11 are a series of spaced integral pillars 30 which have sufficient strength to support the base 11, the components positioned on the base 11, and the weight of the user. The pillars 30 preferably are solid so they can be cut off or trimmed to cause the top surface 25 to take a desired configuration when the user is seated thereon. There are openings 35 which extend through the base 11 to allow body fluids to drain through the base 11.

Figure 9:
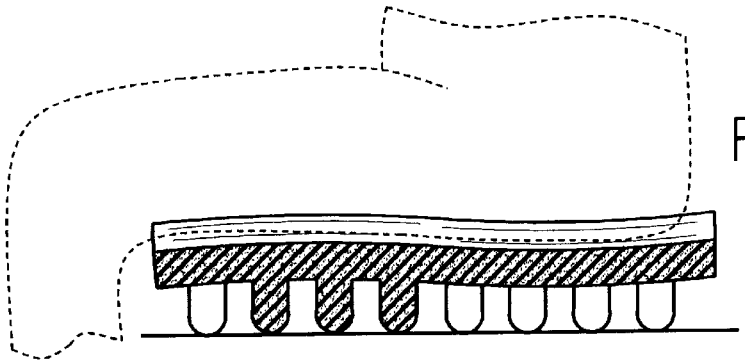
FIG. 9 is a sectional view taken on line 9—9 of FIG. 8 with a user shown in broken lines on the base member.
Figure 10:
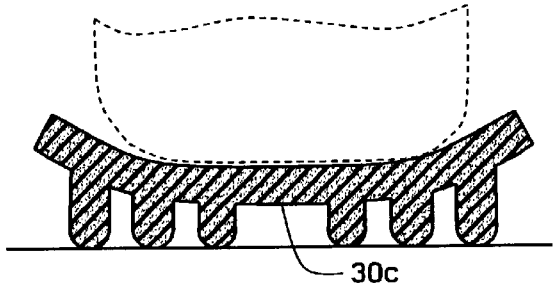
FIG. 10 is a sectional view similar to FIG. 9, but taken on line 10—10 of FIG. 8.
Figure 11:
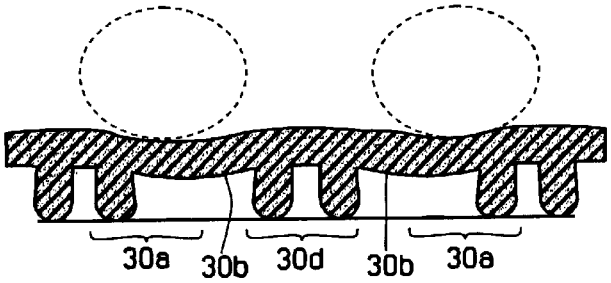
FIG. 11 is a sectional view similar to FIG. 9, but taken on line 11—11 of FIG. 8.

The key to shaping the configuration that the base top surface 25 takes when a user is seated thereon is the height and arrangement of the pillars 30. A typical configuration is shown in FIGS. 8–11. In this configuration (as shown in sectional FIGS. 9–11), the orthotic base 11 is shown with a user (broken lines) seated directly thereon. This configuration has the highest array of pillars 30*a* along the side edges 29,29*a* and there are no pillars 30 beneath the leg and trochanter areas 30*b* and 30*c* respectively. The pillars 30*d* beneath the pommel area also are high to help define the leg troughs 30*b*. FIGS. 9–11 show the pillars 30 trimmed to the desired configuration.

Figure 18:
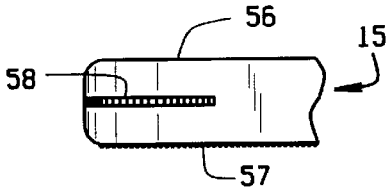
FIG. 18 is a fragmentary plan view of the cushion enclosed in a cover.
Figure 22:
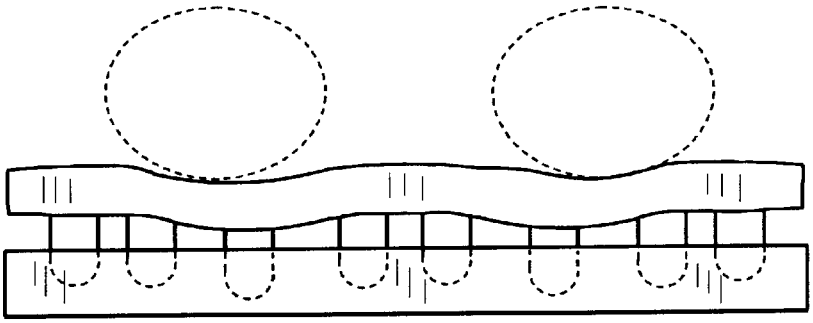
Figure 23:
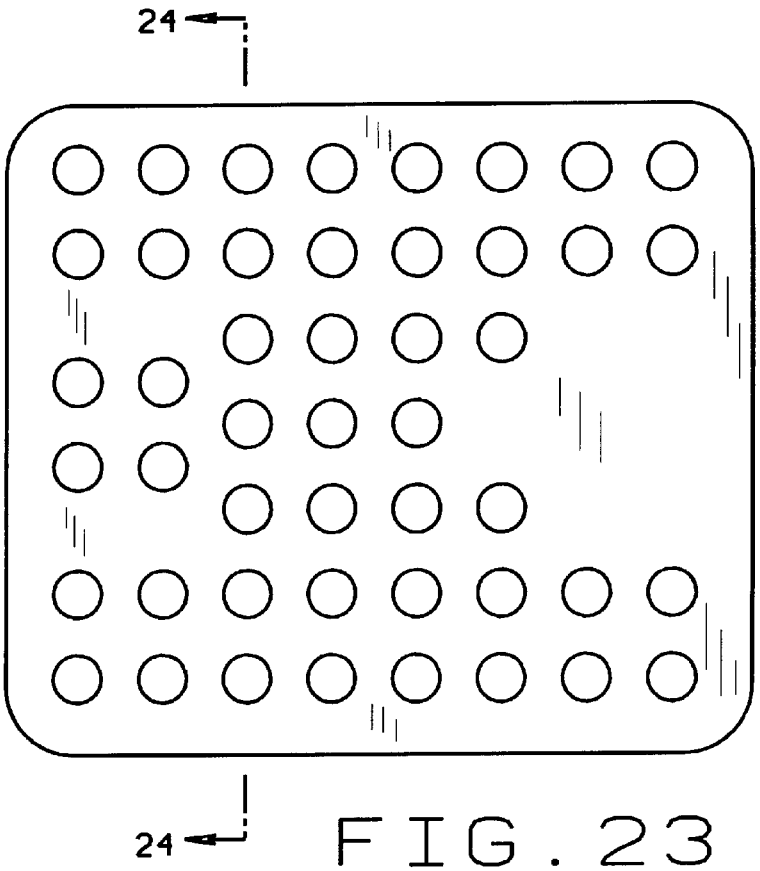
FIG. 23 is a plan view of the impression pad shown in FIGS. 20–22.
Figure 24:
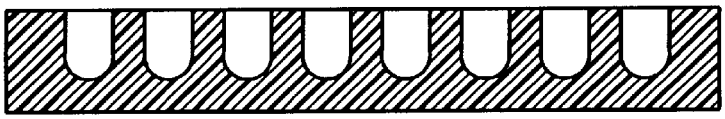
FIG. 24 is a vertical sectional view taken along line 24—24 of FIG. 23.

FIGS. 9–11 show the form of the base 11 which is used when the air cell pad 12 and the balance member 14 are not used. FIG. 18 shows the base 11, the foam pad 13 and the cover 15 as part of a composite cushion. When the air pad 12 is not used, the foam pad 13 does not need a cut-out area 50 in its rear portion. As will be explained hereinafter, the cut-out 50 accommodates the air cell pad 12.

The base 11 has in its top surface 25 an optional "T" shaped depression 31. The depression 31 extends about one-half the thickness of the base 11 and is located adjacent to the rear or back edge 28. The T-shaped depression 31 has a head portion 32 and a tail portion 33. The head portion 32 is wider than the tail portion 33 and extends generally parallel to the back edge 28 and is spaced therefrom by areas 34. The tail portion 33 is parallel to the side edges 29,29*a* and intersects the back edge 28, connecting it to the head portion 32.

The "T" head portion 32 accommodates, retains and supports the air cell module 12. The tail portion 33 gives relief to the coccyx of the user.

Figure 12:
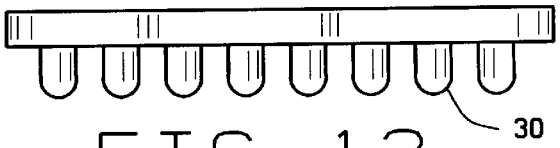
FIG. 12 is a side elevational view of a modification of the base.
Figure 13:
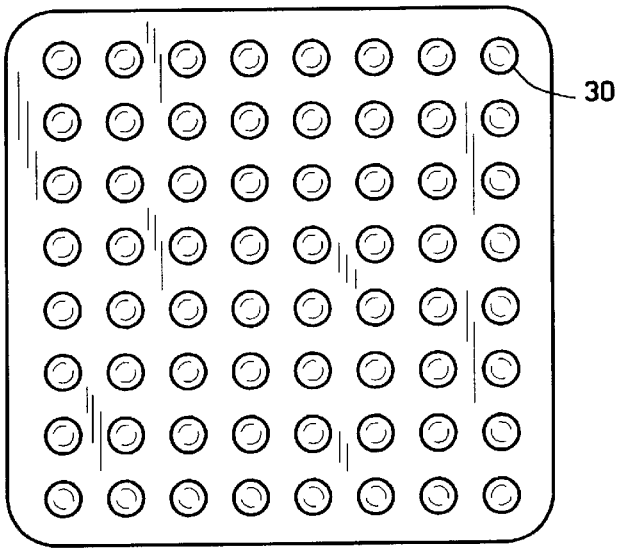
FIG. 13 is a bottom view of the base of FIG. 12.

The pillars 30 also can be cut individually to shape the position of the user, if special positioning is required. The orthotic base 11 also can be made with a uniform set of pillars 30, as shown in FIGS. 12 and 13. The individual user or his doctor or therapist will the cut and trim the pillars 30 to a desired configuration. The density and durometer of the base 11 can vary, but generally a harder plastic is preferred, subject to the needed flexibility to make it conform to the shape of the user.

Figure 14:
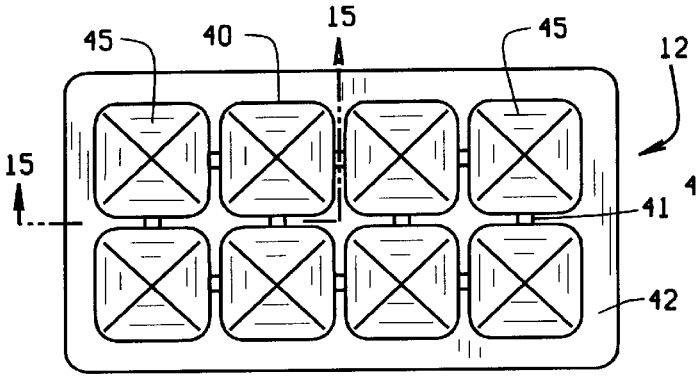
FIG. 14 is a top plan view of the air cell pad of the invention.
Figure 15:
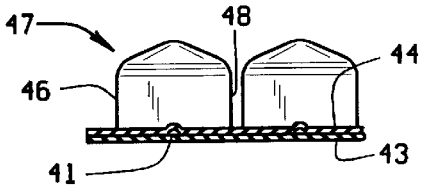
FIG. 15 is a vertical sectional view taken along line 15—15 of FIG. 14.

The air cell pad 12 preferably is a ROHO type air cell pad in which the air cells 40 are interconnected through reduced passages 41 in the base 42 of the pad 12. A typical pad is shown in U.S. Pat. No. 5,152,023 to R. W. Graebe, the substance of which is incorporated herein by reference as fully as if it were set forth in its entirety. The air cell pad 12 preferably is made of dip molded neoprene rubber, but it can be vacuum or air formed as shown in R. H. Graebe U.S. Pat. No. 5,369,828, which also is incorporated herein by reference. The air cell pad 12 is shown more clearly in FIGS. 14 and 15. The pad 12 has a bottom sheet 43 and a top sheet 44 adhered thereto. The top sheet has the air cells 40 which stand upwardly therefrom when inflated. The cells 40 have a rectangular bottom section 46 and a pyramidal top section 47. The bottom section side walls 48 can be spaced apart or can be close enough together to engage and support each other when inflated or when a user is seated thereon. The interconnection of the passages 41 causes each of the cells 45 to be at the same pressure even when a user is seated thereon. The air cell pad can be made without the interconnections 41, if desired. It also can have an inflation nozzle 49, if it is desired to vary the air content of the cells 45.

The top pad 13 preferably is a slab foam pad, but can be convoluted foam, "T" foam, or a gel pad as shown in Jay et al. U.S. Pat. No. 4,726,624. The top pad 13 can be any desired density and resilience to give the feel desired by the user of the cushion. 1.75 pound open cell foam is satisfactory, although higher densities can be used. The pad 13 has sufficient flexibility to conform to the shape of the base top surface 25. At the rear of the pad 13 is a cutout area 50 which is shaped to receive the array of air cells 40. The pad 13 preferably has a thickness which allows the inflated cells 50 to be exposed to the buttocks of the user. The purpose of the top foam pad 13 is to softly blend together the air pad 12 support surface and the top surface 25 of the base 11 to give a comfortable feel to the user of the cushion 10.

Figure 7:
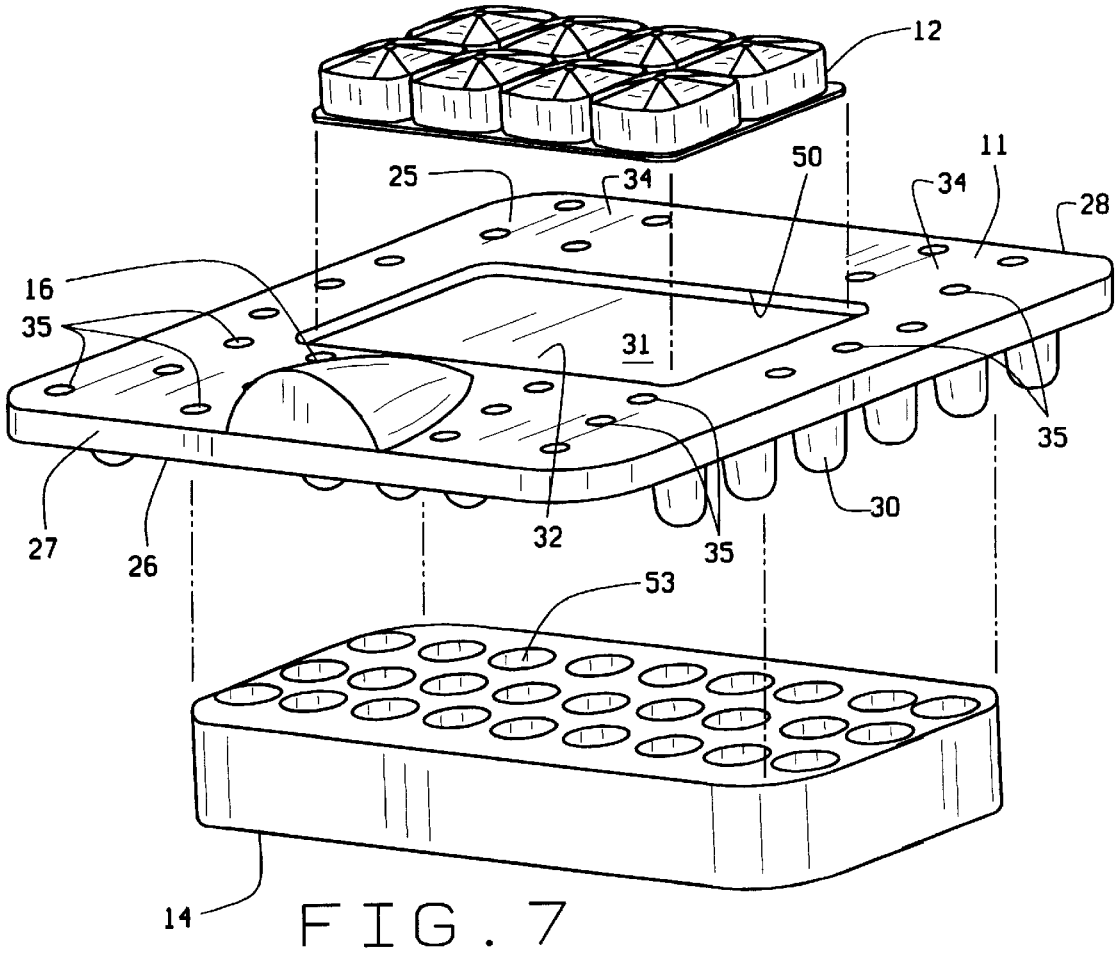
FIG. 7 is an exploded view of a modification of the invention.
Figure 8:
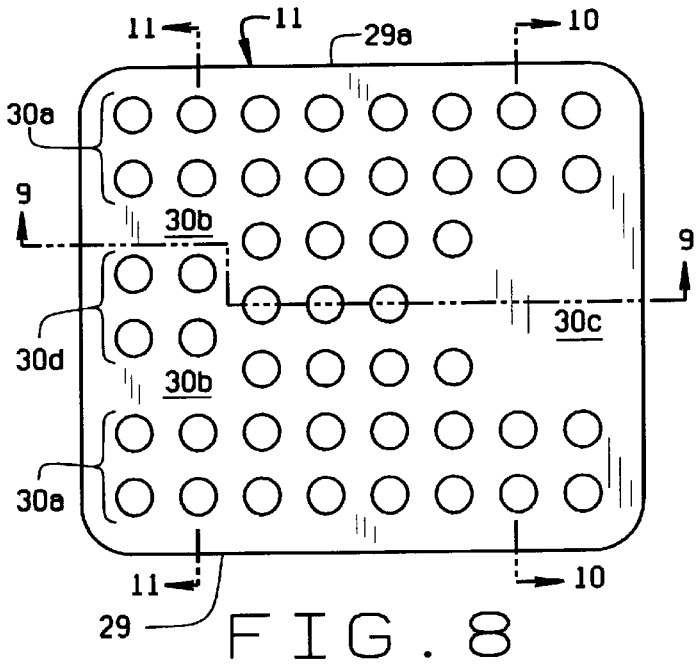
FIG. 8 is a bottom view of a modified base member.
Figure 16:
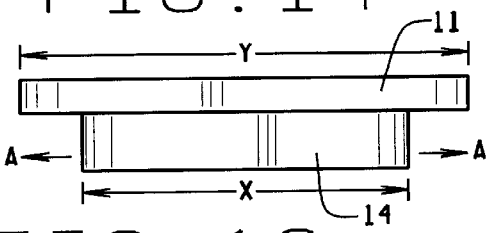
FIG. 16 is a side elevational view of a further modification of the base and bottom pad.

The bottom stabilizer and/or balance member 14 also preferably is made of a porous open cell plastic foam material. 1.75 pound density is satisfactory, but higher densities can be used. The use of the member 14 is optional and it can be made in different shapes. As shown in FIG. 1, it is close to the shape of the base 11 and it is used to absorb body fluids which pass through the base 11. It also preferably is smaller than the base 11 as shown in FIGS. 7 and 16 and thicker than the pillars 30, and its purpose is to shift the balance point of the center of gravity of the user of the cushion 10. In other words, the user can be urged forwardly or rearwardly depending on the location of the member 14 in relation to the orthotic base 11. The balance member 14 is smaller than the base 11 in its front to rear width as indicated by the distances designated by the letters X and Y in FIG. 16. The balance member 14 also has openings 53 therethrough to accommodate the pillars 30. The member 14 is movable rearwardly or forwardly as indicated by the arrows "A" in FIG. 16. In use, the member 14 is removed from the pillars 30 and repositioned in a desired location by reengaging the member openings 53 with a different set of pillars 30. As the member may be absorbent it can act as an absorption pad for user body fluids which pass through the base 11.

FIG. 17 shows the balance member 14 rotated 90° so that it can be moved from side to side beneath the base 11 as indicated by the arrows "B". This allows sidewise adjustment of the patient as necessary.

The cover 15 can be of the type shown in R. H. Graebe U.S. Pat. No. 5,111,544 which is incorporated herein by reference. Generally, the cover is shown in FIGS. 1, 18 and 19 and includes a top surface 56 which may be two-way stretchable and relatively smooth and slick to facilitate removal and access to the cushion 10 by the user. The bottom surface 57 is a non-skid type surface designed to retain the cushion 10 in a desired position on the chair. The side panels 59 preferably are of a non-stretchable material, such as Nylon. An opening 58 in the side panels 59 between the top 56 and bottom 57 is sufficiently long to allow the base 11, cell pad 12, top pad 11, bottom stabilizer 14 and any accessories to be inserted into the cover 15. The opening, 58 can be closed by VELCRO fasteners, zipper type fasteners, snaps, etc. The cover 15 preferably is moisture resistant for use by incontinent persons and it can be air permeable to ventilate the body of the user where it touches the cover top 56.

FIGS. 20–24 show a unique method for measuring the extent to which the base 11 is conformed to the shape of the user seated thereon. This method involves measuring the weight distribution on each of the pillars 30. The pillars 30 are placed on a memory foam pad 70. This type of foam pad 70 is known as T-foam. The top surface 71 is deformable and the bottom of each of the pillars 30 makes a separate impression 72 in the pad 70. In use, the user is placed on the base 11 after the base 11 has been placed on the memory foam pad 70. After a sufficient time the pillars 30 come to equilibrium in the pad 70. By observing and/or measuring the depth of each impression 72, one can determine the force that was exerted on the top of the base 11 above that particular pillar. Thus, the pattern of the depths of the memory pad impression 72 is an indirect measurement of the force distribution on the areas of the skin of the user above each of the pillars (See FIGS. 20–22). The objective of the positioning of the base 11 around the user is to have all of the impressions 72 of the same depth (See FIG. 24), thus indicating equal force on all of the skin area of the patient which engages the base 11.

After the patient and base 11 have been on the memory pad 70 a time sufficient for the pillars 30 and the pad 70 to come to equilibrium, the patient is removed from the base 11 and the base 11 is removed from the memory pad 70. The pillar impressions are observed and the pillars 30 then are trimmed so attempt to size them whereby when a patient is seated on the base 11 and the base 11 is on the memory pad 70, all impressions are the same depth. When the pillar impressions have left the pad 70, the foregoing process is repeated until the base pillars 30 are sized such that all impressions on the foam 70 are approximately the same depth when a patient is seated on the base 11 and the base 11 is on the pad 70.

The memory foam pad 70 is a standard article of commerce in the field. After a period of time sufficiently long to measure or otherwise record the impressed shape, the impressions leave the pad 70 and it returns to its unstressed condition.

This invention is intended to cover all changes and modifications of the example of the invention herein chosen for purposes of the disclosure which do not constitute departures from the spirit and scope of the invention.

What is claimed is:

1. A method of measuring the conformity of a cushion to the shape of a user, said cushion comprising an orthotic member having a main body portion with a top surface adapted to engage and support a user, a bottom surface, a front edge, a back edge and two opposed side edges, the body portion having sufficient strength to support a user and sufficient flexibility to conform to the hips, buttocks and legs of the user to give a larger contact area, lower suspension forces and pressures, and improved pelvic stability and balance to the user, and an array of pillars depending from the bottom surface to engage a support surface to support the body member and the user seated thereon, the top surface of the orthotic member moving to a relatively flat configuration when load is removed, comprising the steps of positioning said cushion on a memory impression pad, placing a user on the cushion so that the pillars engage and deform the pad, removing the person and cushion to expose the memory pad, and reading the depth of the pillar impressions in the pad to determine the force distribution of the user on the cushion.

2. The method of claim 1 including the steps of trimming the pillars to equalize the force distribution of the skin surface of the user on the cushion.

3. The method of claim 2 including the steps of allowing the memory pad to return to its original shape, repositioning the cushion and user on the memory pad, removing the person and cushion to expose the memory pad, and trimming the pillars to further equalize the force distribution of the user on the cushion.

* * * * *